US005588267A

United States Patent [19]

Rodriguez et al.

[11] Patent Number: 5,588,267

[45] Date of Patent: Dec. 31, 1996

[54] MULTI-SIZE ROOF FLASHINGS

[75] Inventors: Roberto Rodriguez, Cleveland; Edward T. Shroka, Rocky River, both of Ohio

[73] Assignee: Oatey Co., Cleveland, Ohio

[21] Appl. No.: 498,574

[22] Filed: Jul. 6, 1995

[51] Int. Cl.[6] ..... E04D 13/14

[52] U.S. Cl. ..... 52/219; 285/4; 285/177; 152/98

[58] Field of Search ..... 52/219, 63, 98, 52/95, 58, 60, 198; 285/3, 4, 177, 42, 43, 44, 201, 215, 233

[56] References Cited

U.S. PATENT DOCUMENTS

| | | |
|---|---|---|
| 1,258,884 | 3/1918 | Fife . |
| 3,125,357 | 3/1964 | Kifer . |
| 3,313,559 | 4/1967 | Kifer . |
| 4,265,058 | 5/1981 | Logsdon . |
| 4,333,660 | 6/1982 | Cupit . |
| 4,563,847 | 1/1986 | Hasty . |
| 4,903,997 | 2/1990 | Kifer . |
| 5,036,636 | 8/1991 | Hasty . |
| 5,176,408 | 1/1993 | Pederson ..... 285/42 |

FOREIGN PATENT DOCUMENTS

| | | |
|---|---|---|
| 1355517 | 6/1974 | United Kingdom . |

*Primary Examiner*—Creighton Smith

*Attorney, Agent, or Firm*—Renner, Otto, Boisselle & Sklar, P.L.L.

[57] ABSTRACT

A roof flashing for establishing a weather-proof seal with upstanding pipes of different diameters includes a frusto-conical shape collar having smaller diameter upper and larger diameter lower seals for sealingly engaging different diameter pipes and an internal annular groove immediately above the lower seal providing a frangible wall section in the collar to facilitate removal of the upper seal from the collar when the collar is to be used to seal against larger diameter pipes. Immediately below the internal groove on the exterior wall of the collar is an external annular bead which together with the lower seal resist stretching of the collar when engaged by a gripping tool immediately above the internal groove and pulled to provide a relatively clean tear in the region of the internal groove around the entire periphery of the collar to separate the upper seal from the collar. The lower seal includes an upper wall portion extending inwardly from the inner wall of the collar that acts as a stop for locating a leading edge of the gripping tool in substantial alignment with the internal groove.

18 Claims, 2 Drawing Sheets

MULTI-SIZE ROOF FLASHINGS

FIELD OF THE INVENTION

This invention generally relates to roof flashings for establishing a weather-proof seal with different diameter pipes protruding through openings in roofs and other exterior walls of building structures.

BACKGROUND OF THE INVENTION

Roof flashings of various types have long been employed to seal around pipes extending through roofs and other exterior walls of houses and other buildings. Such pipes are used, for example, as conduits for electrical or other wiring, or as vent stacks for venting interior plumbing to the atmosphere.

It is also generally known to provide such roof flashings with different diameter seals in order to permit the same roof flashing to be used to establish a weather-tight seal with more than one size pipe. These roof flashings may include a plurality of frangible sections that permit one or more smaller diameter seals to be selectively removed so that one or more larger diameter seals may be used to establish the desired weather-tight seal with larger diameter pipes. Heretofore, a major drawback of these roof flashings was that the frangible sections were either too difficult to remove, or were too easily removed, thus subjecting the roof flashings to potential premature failure.

SUMMARY OF THE INVENTION

The present invention overcomes the various problems enumerated above by providing roof flashings that may easily and effectively be used to establish a weather-proof seal with different diameter pipes without being susceptible to premature failure.

In accordance with one aspect of the invention, the roof flashing includes a frusto-conical shape collar member having a plurality of seals for sealingly engaging different diameter pipes, and an internal annular groove in the collar member between selected seals providing a frangible wall section in the collar member to facilitate removal of one or more smaller diameter seals from the collar member when the collar member is to be used to seal against larger diameter pipes. Outwardly of a larger diameter seal is an external annular bead which, together with the larger diameter seal, resist stretching of the collar member when the collar member is engaged by a gripping tool immediately above the groove and pulled to provide a relatively clean tear around the entire periphery of the collar member just above the bead for removal of the smaller diameter seal or seals from the collar member.

In accordance with another aspect of the invention, the larger diameter seal includes an upper wall portion that extends inwardly from the inner wall of the collar member to act as a stop for locating a leading edge of a gripping tool in substantial alignment with the internal groove in the collar member.

In accordance with another aspect of the invention, the larger diameter seal includes an edge seal having an upper wall that is an extension of a lower wall of the internal groove in the collar member.

In accordance with still another aspect of the invention, the lower edge seal has a generally triangular shape cross section.

In accordance with another aspect of the invention, the external bead is generally rounded.

In accordance with another aspect of the invention, the larger diameter seal includes a plurality of axially spaced apart edge seals that form a multiple seal with larger diameter pipes, one of the edge seals being directly opposite the external bead, and one or more other edge seals being below the external bead.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
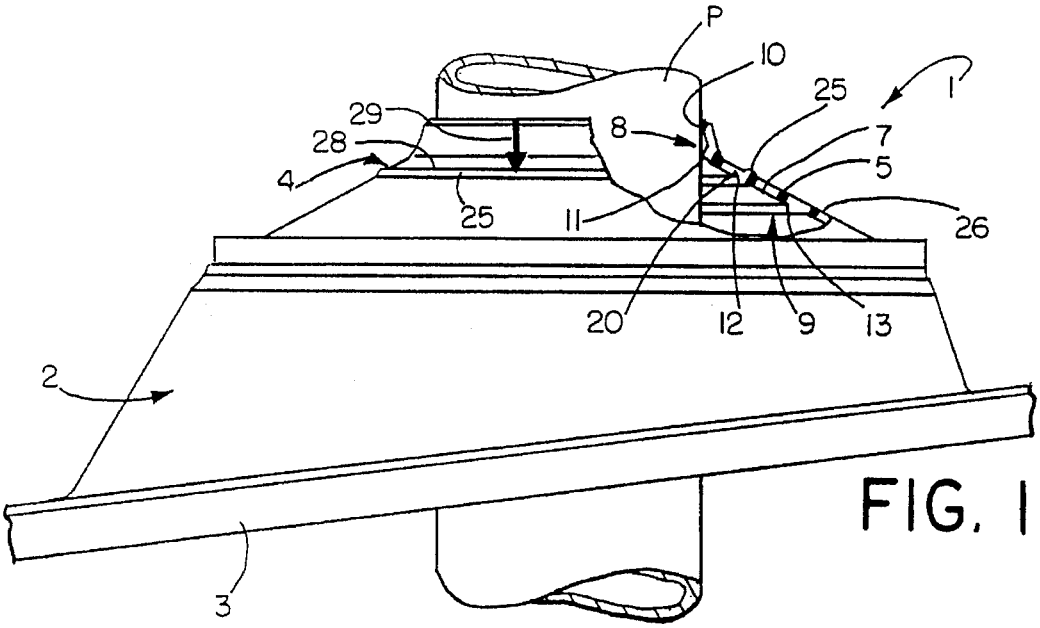
FIG. 1 is a side elevation view, partly in section, of a preferred form of roof flashing in accordance with this invention shown installed on a roof with an upstanding pipe extending through the collar member of the roof flashing.

Referring now in detail to the drawings, and initially to FIG. 1, there is shown a preferred form of roof flashing 1 in accordance with this invention including a base member 2 adapted to be secured to a roof or other exterior wall structure 3 of a house or other building structure and a collar member 4 operative to provide a water-tight seal with an upstanding member such as an electrical conduit or vent pipe 5 projecting outwardly through the roof or exterior wall structure.

If desired, the entire flashing 1 including the base member 2 and collar member 4 may be integrally molded as a single unit out of a suitable plastic. However, this is a relatively expensive molding operation, and requires that the base member be made out of the same elastomeric material as the collar, which may unnecessarily add to the cost of the flashing, in that the material specifications for the collar are usually much more demanding than those for the base member because of the requirements that the collar be sufficiently flexible in order to form the desired weather-tight seal with a range of pipe sizes on different pitched roofs. Accordingly, it may be advantageous to make the collar and base member separately so that different types of elastomeric materials can be used for each member, and join the collar to the base member in any suitable manner, for example, by molding the collar directly onto the base member in the manner disclosed in U.S. Pat. No. 4,903,997 assigned to the same assignee as the present application, the entire disclosure of which is incorporated herein by reference. Alternatively, the base member may be made out of a suitable metal such as aluminum and the elastomeric collar may be mechanically attached to the base member in any suitable manner, for example, by crimping a metal annular groove on the base member into gripping engagement with an annular bead projecting inwardly from the inner wall of the collar adjacent the base thereof as shown in U.S. Pat. No. 3,313,559 assigned to the same assignee as the present application, the entire disclosure of which is also incorporated herein by reference.

Figure 2:
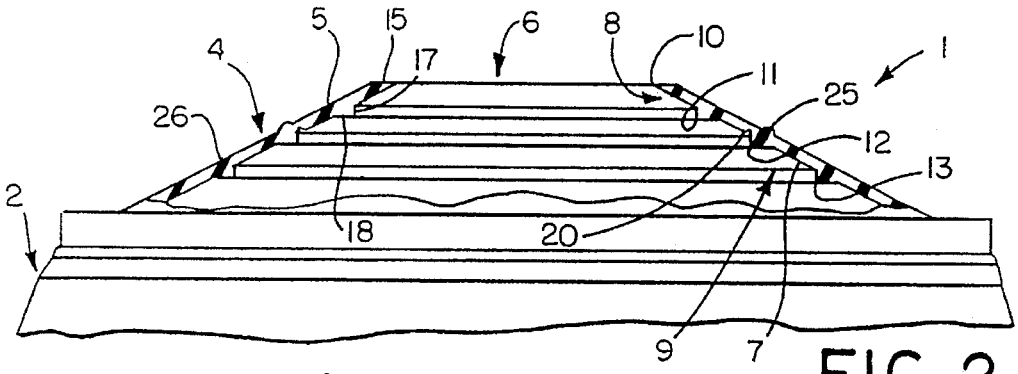
FIG. 2 is an enlarged fragmentary vertical section through the smaller and larger diameter seal portions of the collar member of the roof flashing in its relaxed, unstressed condition prior to installation.

The collar member 4 may be molded out of any suitable elastomeric material that will stand up under the extreme environmental conditions to which the roof flashing may be subjected and which is also sufficiently flexible and pliable to allow the collar member to be stretched and distended upwardly in order to fit over different diameter pipes and form the desired weather-tight seal therewith as described hereafter. Prior to installation, the collar member 4 is in the shape of a thin walled truncated cone 5, with a central circular opening 6 through the apex thereof as shown in FIG. 2. On the inner wall 7 of the collar member 4 are two sets of seals 8, 9, each set desirably including two edge seals 10, 11 and 12, 13, respectively, for providing a double seal with different diameter pipes depending on the size of collar member used. For example, one collar member may be sized such that the smaller diameter upper set of edge seals 10, 11 may be used to form a double seal with 2 inch pipe and at least one seal with 1½ inch pipe, and the larger diameter lower set of seals 12, 13 may be used to form a double seal with 3 inch pipe; another collar member may be sized such that the smaller diameter upper set of edge seals 10, 11 may be used to form a double seal with 3 inch pipe and the larger diameter lower set of edge seals 12, 13 used to form a double seal with 4 inch pipe, etc.

As clearly illustrated in FIG. 2, the apex end 15 of the truncated cone 5 adjacent the central opening 6 is desirably substantially flat in the plane of the opening so as to define with the inner wall 7 of the truncated cone the upper edge seal 10 of the smaller diameter upper set of seals 8. The lower edge seal 11 of the upper set of seals 8, on the other hand, is desirably formed by two radially and axially extending walls 17, 18 that intersect to define a right angled edge seal having a triangular cross section.

The inner diameter of the upper edge seal 10 is of course less than the inner diameter of the lower edge seal 11. Moreover, the inner diameter of the lower edge seal 11 is also slightly less than the outer diameter of the smallest diameter pipe to be sealed thereby. By making the collar out of a relatively flexible, pliable elastomeric material, the smaller diameter edge seals 10, 11 may be used to form a weather-proof seal with 2 inch pipe as well as 1½ inch pipe.

When the collar member 4 is forced over the upper end of 1½ inch or 2 inch pipe P, the apex end 15 of the truncated cone 5 from slightly below the lower edge seal 11 of the upper set 8 will be stretched and distended upwardly in the manner shown in FIG. 1 in order to fit over the pipe. In this manner an extremely weather-tight seal is formed between the pipe P and collar 4, there being at least two high pressure sealing points established by the edge seals 10 and 11 with the larger diameter pipe and at least one high pressure sealing point established by the edge seal 11 with the larger diameter pipe.

While two seals are shown in each set, it will be appreciated that each set may include only a single seal if desired. Also, more than two seals, for example, three seals may be provided at least in the first set to ensure at least a double seal with smaller diameter pipe when the upper set of seals is used to form a weather-tight seal with two different pipe sizes, such as 1½ inch pipe and 2 inch pipe.

Figure 3:
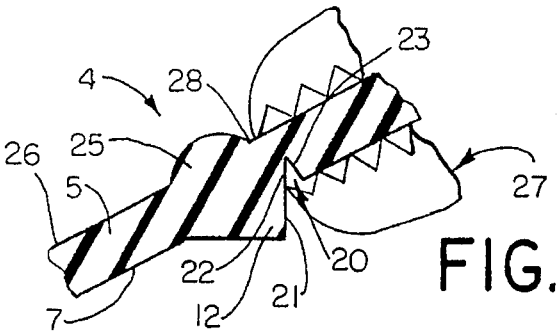
FIG. 3 is an enlarged fragmentary section through the frangible section of the collar member.

To permit the lower larger diameter set of edge seals 12, 13 to be used for sealing against larger size pipe, for example, 3 inch pipe, the upper set of seals 10, 11 must first be removed from the collar member. To facilitate such removal, an internal annular groove 20 is provided in the inner wall 7 of the collar member immediately above the upper edge seal 12 of the lower larger diameter set of seals 9. Preferably, both edge seals 12, 13 of the lower set of seals 9 are formed by radially and axially extending walls on the inner wall 7 of the collar member which intersect to define a right angle therebetween having a triangular cross section, similar to the lower edge seal 11 of the upper set of seals 9. Also, as best seen in FIG. 3, the upper wall 21 of the upper edge seal 12 of the lower set of seals 9 desirably forms an extension of the lower wall 22 of the internal groove 20. The upper wall 23 of the internal groove desirably extends substantially perpendicular to the inner wall 7 of the collar member, intersecting the lower wall 22 approximately at the middle of the thickness of wall of the collar member 4.

Directly opposite and outwardly of the upper edge seal 12 of the lower set of seals 9 is an external annular bead 25 on the outer wall 26 of the collar member that cooperates with the edge seal 12 to resist stretching of the collar member when engaged by a gripping tool such as a pliers 27 immediately above the upper edge 28 of the external bead 25 and internal groove 20 and pulled to provide a relatively clean tear adjacent the upper edge 28 of the external bead 25 around the entire periphery of the collar member to separate the upper set of seals 8 from the collar member. As best seen in FIG. 3, the external bead 25 is generally rounded in cross section with its upper edge 28 located slightly below the internal groove 20. Also, the upper wall 21 of the upper edge seal 12 of the lower set of seals 9 extends inwardly from the inner wall 7 of the collar member 4 to act as a stop for locating the leading edge of the gripping tool 27 in substantial alignment with the internal groove 20 as further schematically shown in FIG. 3. Suitable indicia such as an arrow 29 (see FIG. 1) may also be provided on the exterior surface of the collar adjacent the upper edge 28 of the external bead 25 to indicate where the outer jaw of the gripping tool should engage the outer wall of the collar at the point of the arrow.

Figure 4:
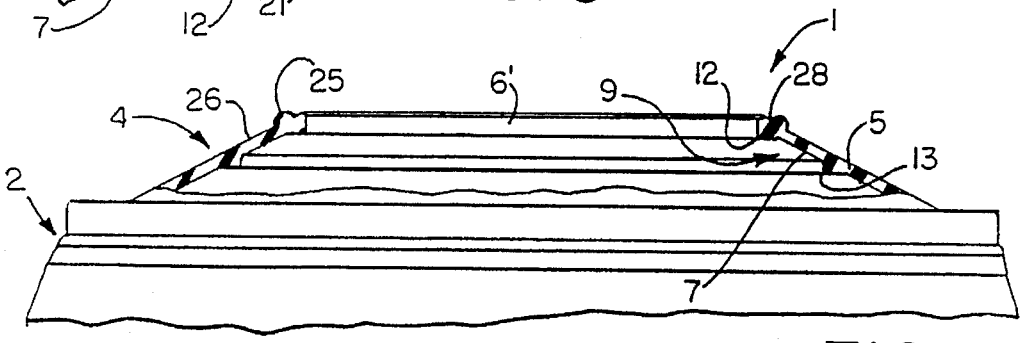
FIG. 4 is an enlarged fragmentary vertical section through the collar similar to FIG. 2 but with the smaller diameter seal portion removed.
Figure 5:
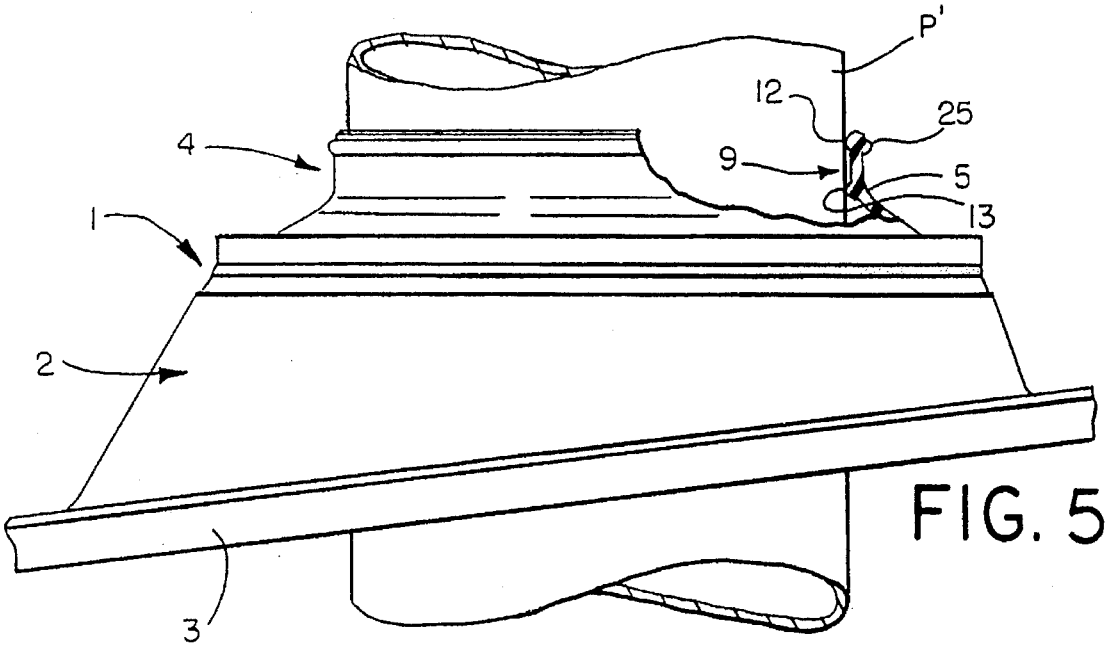
FIG. 5 is a side elevation view, partly in section, showing the collar of FIG. 4 with the smaller diameter seal portion removed installed on a roof with an upstanding pipe extending through the collar.

FIG. 4 shows the collar member 4 with the upper set of seals 8 removed, thus locating the lower set of seals 9 adjacent the resulting larger diameter opening 6' in the apex end of the collar member for forming a weather-tight seal with a larger diameter pipe P', for example, a 3 inch pipe, by forcing the collar member 4 over the upper end of the larger diameter pipe P' to cause the remaining portion of the collar member from slightly below the lower edge seal 13 of the lower set of seals 9 to be stretched and distended upwardly as schematically shown in FIG. 5 in order to fit over the larger diameter pipe with the two edge seals 12, 13 of the lower set of seals 9 forming a double seal with the larger diameter pipe.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A roof flashing with an elastomeric collar for establishing a weather-proof seal with upstanding pipes of different diameters extending through exterior openings in building structures, said collar comprising a frusto-conical shape member having an opening in an apex end for passage of the pipe, said member including smaller and larger diameter seals for sealingly engaging different diameter pipes, an internal annular groove in said member immediately above said larger diameter seal providing a frangible wall section in said member to facilitate removal of said smaller diameter seal from said member when said member is to be used to seal against larger diameter pipes, and an external annular bead on said member for resisting stretching of said member when engaged by a gripping tool immediately above said groove and pulled to provide a relatively clean tear in a region of said groove around an entire periphery of said member to separate said smaller diameter seal from said member.

2. The roof flashing of claim 1 wherein said larger diameter seal includes an edge seal having an upper wall that forms an extension of a lower wall of said groove.

3. The roof flashing of claim 2 wherein said edge seal is generally triangular shape in cross section.

4. The roof flashing of claim 3 wherein said edge seal includes a lower wall that intersects said upper wall to define a right angle therebetween.

5. The roof flashing of claim 2 wherein said groove is generally triangular shape in cross section.

6. The roof flashing of claim 1 wherein said external bead is generally rounded.

7. The roof flashing of claim 1 wherein said larger diameter seal includes a plurality of axially spaced seal members that form plural seals with larger diameter pipes.

8. The roof flashing of claim 7 wherein said seal members are generally triangular shape in cross section.

9. The roof flashing of claim 1 wherein said smaller diameter seal includes a plurality of axially spaced seal members that form one or more seals with smaller diameter pipes.

10. The roof flashing of claim 9 wherein one of said seal members of said smaller diameter seal is formed by an intersection of said apex end with an inner wall of said member.

11. The roof flashing of claim 10 wherein said apex end is substantially flat in a plane of said opening in said apex end and intersects an inner wall of said member at an acute angle to define said one seal member.

12. The roof flashing of claim 1 wherein said larger diameter seal includes a pair of axially spaced apart edge seals that form a double seal with larger diameter pipes when said smaller diameter seal is removed from said member, one of said edge seals of said larger diameter seal being located immediately below said internal groove.

13. The roof flashing of claim 1 wherein said larger diameter seal includes a wall portion that extends inwardly from an inner wall of said member immediately below said internal groove to act as a stop for locating a leading edge of the gripping tool in substantial alignment with said internal groove prior to engaging said member with the gripping tool.

14. The roof flashing of claim 13 wherein said wall portion of said larger diameter seal forms an extension of a lower wall of said internal groove.

15. A roof flashing comprising a base member adapted to be secured to an exterior wall surface, and an elastomeric collar for establishing a weather-proof seal with a pipe extending through an opening in the exterior wall surface, said collar being of generally frusto-conical shape having an opening in an apex end for passage of the pipe, said collar having smaller diameter upper and larger diameter lower seals for sealingly engaging different diameter pipes, an internal annular groove intermediate said upper and lower seals providing a frangible wall section in said collar to facilitate removal of said upper seal from said collar when said collar is to be Used to seal against larger diameter pipes, and an external annular bead on said collar immediately below said internal groove to resist stretching of said collar when engaged by a gripping tool immediately above said internal groove and pulled to provide a relatively clean tear in a region of said internal groove around an entire periphery of said collar to separate said upper seal from said collar.

16. The roof flashing of claim 15 wherein said lower seal includes a wall portion that extends inwardly from an inner wall of said collar to act as a stop for locating a leading edge of the gripping tool in substantial alignment with said internal groove prior to engaging said collar by the gripping tool and pulling to separate said upper seal from said collar.

17. The roof flashing of claim 16 wherein said wall portion of said lower seal forms an extension of a lower wall of said internal groove.

18. The roof flashing of claim 16 wherein said lower seal includes a plurality of axially spaced apart seal members that form plural seals with larger diameter pipes when said upper seal is separated from said collar, said wall portion comprising an upper wall of one said seal members.

* * * * *